US006449921B1

(12) United States Patent
Kim

(10) Patent No.: US 6,449,921 B1
(45) Date of Patent: Sep. 17, 2002

(54) TABLET SUPPLYING AND PACKAGING APPARATUS HAVING TURNTABLE AND TABLET CASSETTES

(75) Inventor: Jin S. Kim, Taegu (KR)

(73) Assignee: JV Medi Co., Ltd., Taegu (KR)

( * ) Notice: Subject to any disclaimer, the term of this patent is extended or adjusted under 35 U.S.C. 154(b) by 2 days.

(21) Appl. No.: 09/835,178

(22) Filed: Apr. 16, 2001

(51) Int. Cl.[7] ..... B65B 35/54
(52) U.S. Cl. ..... 53/154; 53/493
(58) Field of Search ..... 221/265; 53/493, 53/154, 155, 237, 238, 445, 474, 168, 550

(56) References Cited

U.S. PATENT DOCUMENTS

| | | | | | |
|---|---|---|---|---|---|
| 1,912,248 | A | * | 5/1933 | Bateman et al. | 221/204 |
| 5,097,652 | A | | 3/1992 | Inamura et al. | |
| 5,219,095 | A | | 6/1993 | Shimizu et al. | |
| 5,481,855 | A | * | 1/1996 | Yuyama | 53/168 |
| 5,667,096 | A | | 9/1997 | Wu | |
| 5,671,592 | A | | 9/1997 | Yuyama et al. | |
| 5,709,063 | A | | 1/1998 | Yuyama et al. | |
| 5,765,606 | A | | 6/1998 | Takemasa et al. | |
| 5,803,309 | A | | 9/1998 | Yuyama et al. | |
| 5,839,257 | A | | 11/1998 | Soderstrom et al. | |
| 5,852,911 | A | | 12/1998 | Yuyama et al. | |
| 5,963,453 | A | * | 10/1999 | East | 53/493 |
| 6,170,229 | B1 | | 1/2001 | Kim | |
| 6,170,230 | B1 | * | 1/2001 | Chudy et al. | 53/168 |
| 6,170,699 | B1 | | 1/2001 | Kim | |
| 6,308,494 | B1 | * | 10/2001 | Yuyama et al. | 53/131.3 |
| 6,394,308 | B1 | * | 5/2002 | Yuyama et al. | 221/119 |

* cited by examiner

*Primary Examiner*—John Paradiso
(74) *Attorney, Agent, or Firm*—John K. Park; Park & Sutton LLP

(57) ABSTRACT

A tablet supplying and packaging apparatus comprises a housing, a turntable having tablet containers with plates each hingedly engaged a container portion, so tablets are either maintained in each container or downwardly discharged when said plate is released. A cassette unit has an upper hopper, a cassette stand and a row of tablet cassettes detachably mounted on the cassette stand, so tablets are released from the cassettes and guided by an upper hopper. A lower hopper below the turntable and the upper hopper guides the tablets into a tablet packaging assembly below the lower hopper for packaging the tablets selectively released from the cassettes and the tablet containers into tablet paper bags.

20 Claims, 4 Drawing Sheets

TABLET SUPPLYING AND PACKAGING APPARATUS HAVING TURNTABLE AND TABLET CASSETTES

BACKGROUND OF THE INVENTION

The invention relates to a tablet supplying and packaging system for a prescription drug preparation. More particularly, the present invention relates to a tablet supplying and packaging apparatus which optimally combines a turntable container based system and a cassette based system to enable both a rotational tablet supplementation and a cassette-applied tablet distribution.

A doctor's prescription generally requires one or more kinds of tablets depending on a disease type. So the more types of illnesses are reflected in a prescription, the more kinds of different tablets should a patient take per dosage. The dosage may vary from once per day to three or more times per day depending on seriousness and types of disease or how many different types of illnesses the patient suffers from.

However, as is generally known among doctors and pharmacists, the dosage per patient does not exceed five tablets per day in most prescriptions. So a mid to small size drugstores that cannot afford a costly tablet packaging system strongly require a compact size tablet supplying and packaging system which occupies less space while realizing a competitive performance. Compared to a large costly tablet packaging system, a compact size tablet supplying and packaging system needs to perform an automatic operation for tablet packaging once tablets are manually filled in tablet containers such as tablet cassettes.

Accordingly, there has been a strong demand on improvement of tablet supplying and packaging performance as well as space efficiency for such a compact size tablet packaging system.

SUMMARY OF THE INVENTION

The present invention is contrived to overcome the conventional disadvantages. Therefore, an object of the invention is to realize a compact size tablet supplying and packaging apparatus which optimally combines a turntable container based system and a cassette based system, thereby realizing a compact size tablet supplying and packaging system with high performance.

Another object of the invention is to implement compatibility between a manual tablet supplying mechanism and an automatic tablet cassette mechanism, thereby maximizing usability while improving product reliability.

To achieve the above-described objects, the tablet supplying and packaging apparatus according to the present invention comprises: a housing having an upper surface; a turntable exposedly embedded in the upper surface of the housing, wherein the turntable has a center and a plurality of tablet containers disposed around the center, wherein the turntable angularly rotates on the center thereof, wherein said each tablet container is defined by side walls, a top opening and a bottom opening; and a plurality of plates corresponding to the plurality of tablet containers, wherein said each plate is hingedly engaged to a tablet container portion adjacent to the bottom opening of said each tablet container to releasably close the bottom opening of said each tablet container, whereby one or more tablets serving as a first tablet batch for a unit dosage are either maintained in said each tablet container when the bottom opening is closed by said plate or downwardly discharged when said plate is released.

The apparatus further comprises: a cassette unit having an upper hopper, a cassette stand and a row of tablet cassettes detachably mounted on the cassette stand, wherein the cassette stand is formed on the upper surface of the housing in adjacency to the turntable, wherein the upper hopper is formed below the cassette stand and through the upper surface of the housing, whereby one or more tablets serving as a second tablet batch for the unit dosage are released from the tablet cassettes and guided by the upper hopper; a lower hopper disposed below the turntable and the upper hopper of the cassette unit to guide the first and second tablet batches; and a tablet packaging assembly disposed below the lower hopper for packaging the tablet batches selectively released from said tablet cassettes and said tablet containers into a plurality of tablet paper bags.

For a better performance, the apparatus further comprises: a support rail having a release opening, wherein the support rail is disposed beneath the bottom openings of the tablet containers to uphold the plates, where in when one selected from the tablet containers reaches over the release opening in accordance with the angular rotation of the turntable, the plate corresponding to the selected tablet container is lowered through the release opening so that the tablets in the selected tablet container are downwardly released through the release opening into the lower hopper; a vertical shaft fixed to the center of the turntable to support and center the turntable; and an operation control administering the turntable and the tablet cassettes for a tablet release operation in accordance with a data input therein.

The vertical shaft is engaged thereto by a motor to generate a force for the angular rotation of the turntable, and the motor is controlled by the operation control. The angular rotation of the turntable may be either clockwise or counterclockwise. A sensor may be connected to the operation control for sensing the angular rotation of the turntable in accordance with the operation control to allow the tablets to be regularly discharged from the tablet containers through the release opening into the packaging assembly. Each tablet container has a sensing member disposed adjacent thereto to enable the sensor to detect the angular rotation of the turntable in accordance with the operation control, wherein the sensing member is magnetized. In case the upper hopper is defined by a front panel, a rear panel and side panels, then an angle defined by the front panel and a horizontal line is larger than a corresponding angel defined by the rear panel and the horizontal line.

In an embodiment, a disk may be provided between the turntable center and the tablet containers so as to identify said each container. The disk may be rotatable either separately from the turntable or engagedly to the turntable. With a provision of a numbering system the disk may visually gauge a tablet loading in the tablet containers.

The advantages of the present invention are: (1) the rotational tablet supplying mechanism realized by the turntable and the support rail therebelow reliably combines a manual tablet distribution into the tablet containers with an automated tablet conveying and dropping into the heater assembly for the tablet packaging, thereby substantially improving efficiency of prescription drug packaging; (2) the tablet supplying and packaging apparatus optimally combines a turntable container based system and a cassette based system, thereby enabling a small to medium size drugstore to economically adopt an automated tablet distributing and packaging facility; and (3) the numbering system implemented on the disk of the turntable further facilitates the manual tablet distribution in the tablet containers with accuracy, thereby maximizing efficiency of the tablet supplying and packaging mechanism.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE PREFERRED EMBODIMENTS

Figure 1:
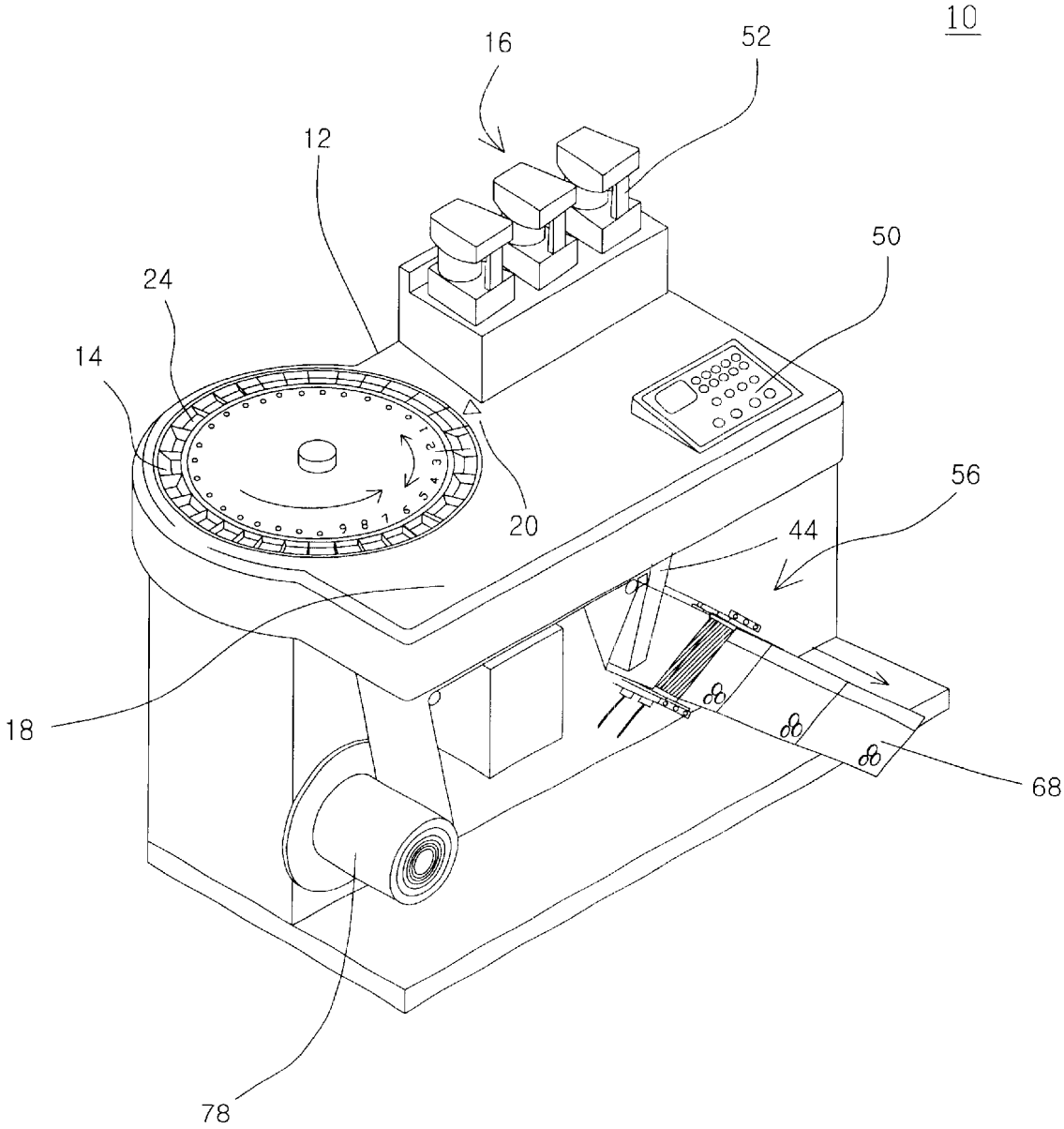
FIG. 1 is a perspective view showing a tablet supplying and packaging apparatus according to the present invention.

As shown in FIG. 1, a tablet supplying and packaging apparatus 10 according to the present invention comprises a housing 12, a turntable 14, and a cassette unit 16. The housing 12 has an upper surface 18. The turntable 14 is exposedly embedded in the upper surface 18 of the housing 12. Preferably, the turntable 14 is placed to a side of the upper surface 18. A static pointer 20 is formed adjacent to the turntable 14 on the upper surface 18 of the housing 12.

Figure 2:
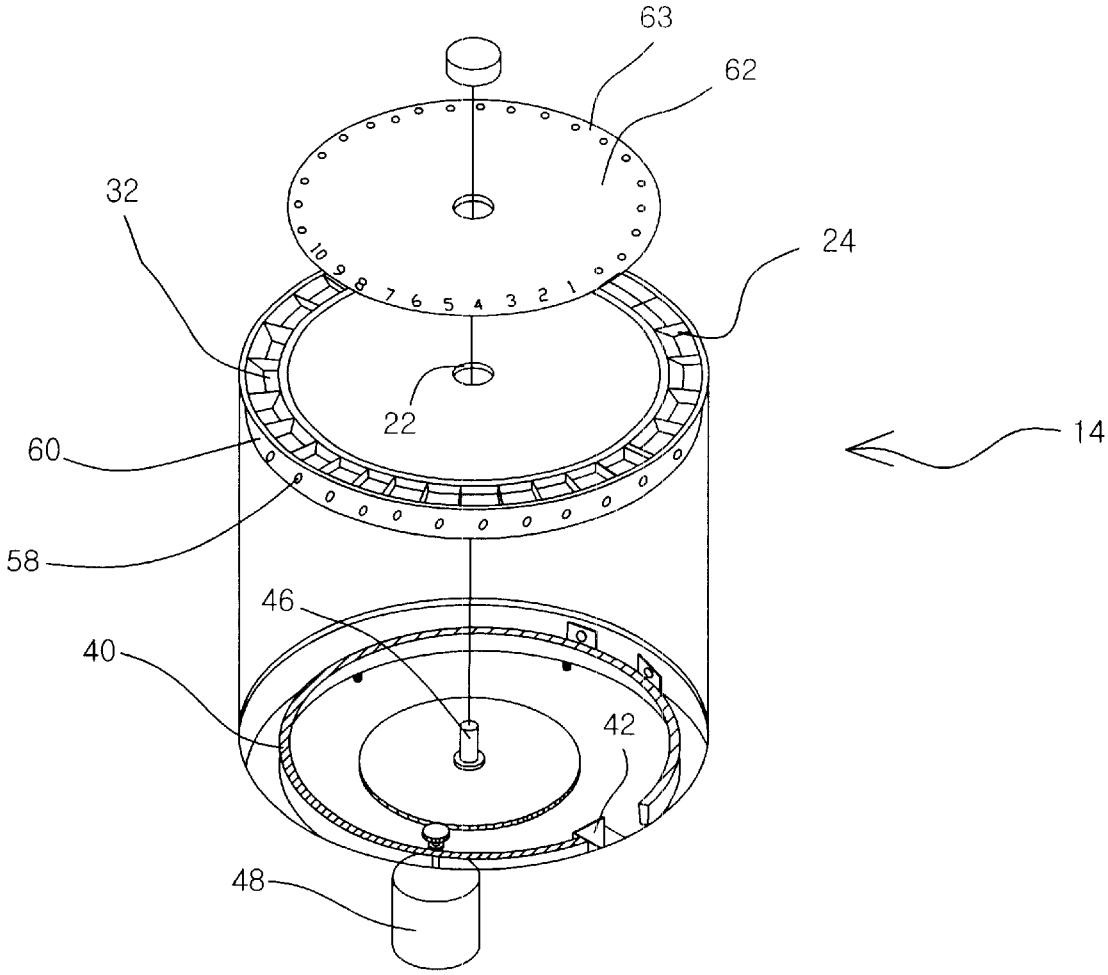
FIG. 2 is an exploded view detailing a turntable mechanism according to the present invention.
Figure 3:
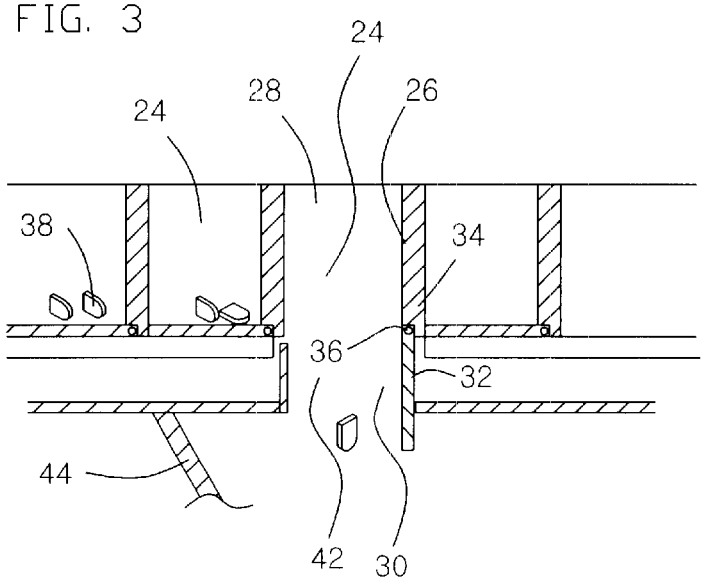
FIG. 3 is a schematic side view detailing a tablet dropping from containers of the turntable.

Referring to FIGS. 2 and 3, the turntable 14 has a center 22 and a plurality of tablet containers 24 disposed around the center 22. In this construction, the turntable 14 angularly rotates on the center 22 thereof. Each tablet container 24 is defined by side walls 26, a top opening 28 and a bottom opening 30.

A plurality of plates 32 are provided to correspond to the plurality of tablet containers 24 such that each plate 32 is hingedly engaged to a tablet container portion 34 adjacent to the bottom opening 30 of each tablet container 24 to releasably close the bottom opening 30 of each tablet container 24.

More specifically, a hinge 36 allows the plate 32 to downwardly release when required, whereby one or more tablets 38 serving as a first tablet batch for a unit dosage are either maintained in each tablet container 24 when the bottom opening 30 is closed by the plate 32 or downwardly discharged when the plate 32 is released.

As shown back in FIG. 2, a support rail 40 is disposed beneath the bottom openings 30 of the tablet containers 24 to uphold the plates 32. The support rail 40 has a release opening 42 so that when one selected from the tablet containers 24 reaches over the release opening 42 in accordance with the angular rotation of the turntable 14, the plate 32 corresponding to the selected tablet container 24 is lowered through the release opening 42, whereby the tablets maintained in the selected tablet container 24 are downwardly released through the release opening 42 into a lower hopper 44 disposed below the turntable 14 to communicate with the release opening 42 of the support rail 40.

A vertical shaft 46 is fixed to the center 22 of the turntable 14 to support and center the turntable 14. The vertical shaft 46 is engaged thereto by a motor 48 to generate a force for the angular rotation of the turntable 14. The motor is controlled by an operation control 50 as shown in FIG. 1.

The operation control 50 administers the turntable 14 and a plurality of tablet cassettes 52 incorporating the cassette unit 16 for a tablet release operation in accordance with a data input therein.

In a preferred version, the tablet distributing and packaging apparatus further comprises a sensor 54 connected Lo the operation control 50 for sensing the angular rotation of the turntable 14 in accordance with the operation control 50 to allow the tablets 38 to be regularly discharged from the tablet containers 24 through the release opening 42 into a packaging assembly 56 provided below the lower hopper 44.

Each tablet container 24 has a sensing member 58 disposed adjacent thereto to enable the sensor 54 to detect the angular rotation of the turntable 14 in accordance with the operation control. The sensing member 58 may be magnetized. Preferably, the sensing member 58 is formed along an outer periphery 60 of the turntable 14 to facilitate the sensing of the turntable angular rotation by the sensor 54.

As specified in FIG. 2, in an embodiment, the turntable 14 further includes a disk 62 detachably provided between the turntable center 22 and the tablet containers 24. The disk 62 serves to identify each container 24 with a provision of a numbering system 63 to visually gauge a tablet loading in the tablet containers 24. For example, when a required amount of tablets are loaded in the selected tablet containers 24, a number "1" marked on the disk 62 proceeds counterclockwise in correspondence to the angular rotation of the turntable 14 until the number "1" becomes aligned with the static pointer 20. At this moment, the plate 32 corresponding to the tablet container 24 positioned between the number "1" and the static pointer 20 is downwardly dropped through the release opening 42, whereby the tablets 38 sustained by the plate 32 in the tablet container 24 becomes released through the release opening 42 into the lower hopper 44. Then, the further angular rotation of the turntable 14 leads the subsequent number "2" to take the place of the previous number "1" and align with the static pointer 20 so that the subsequent batch of tablets becomes released into the lower hopper 44.

Meanwhile, when all the batches of tablets designated by the operation control 50 are released from the tablet containers 24, the disk 62 may be returned either automatically or manually so the number "1" becomes realigned with the static pointer 20. For a better performance, the disk 62 may be rotatable either separately from the turntable 14 or engagedly to the turntable 14. Accordingly, the angular rotation of the turntable may be either clockwise or counterclockwise.

Figure 4:
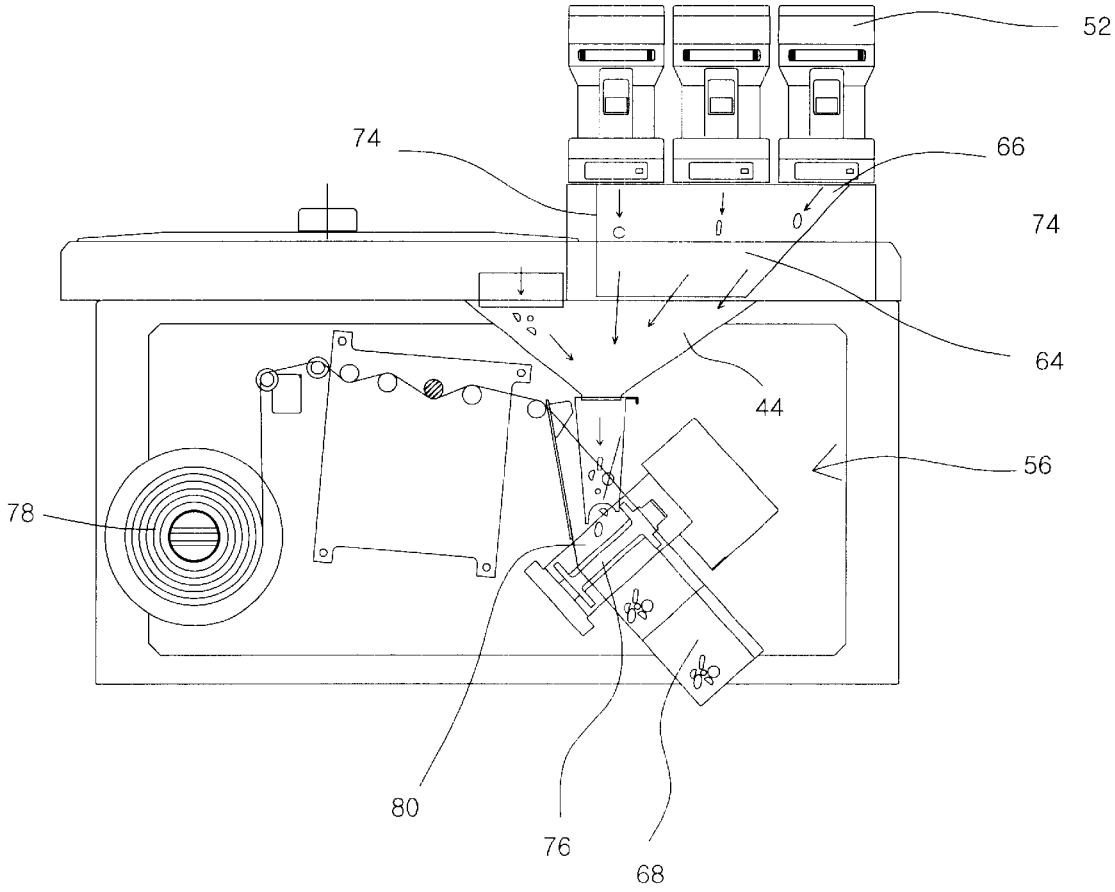
FIG. 4 is a schematic front view of FIG. 1.
Figure 5:
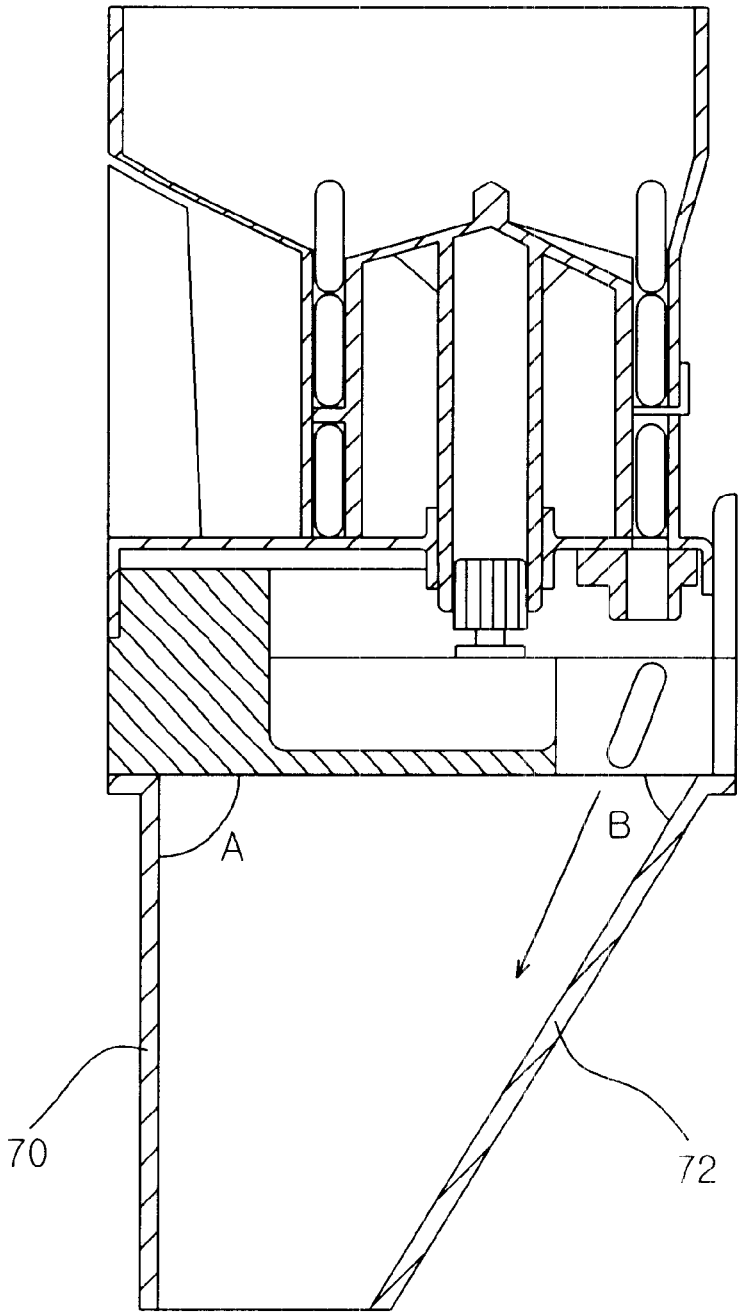
FIG. 5 is a cross-sectional view showing a cassette mechanism according to the present invention.

Referring to FIGS. 4 and 5, the cassette unit 16 includes an upper hopper 64, a cassette stand 66 and a row of tablet cassettes 52 detachably mounted on the cassette stand 66. The cassette stand 66 is formed on the upper surface 18 of the housing 12 in adjacency to the turntable 14. The upper hopper 64 is formed below the cassette stand 66 and through the upper surface 18 of the housing 12, whereby one or more tablets serving as a second tablet batch for the unit dosage are released from the tablet cassettes 52 and guided by the upper hopper 64. In this construction, the lower hopper 44 disposed below the turntable 14 and the upper hopper 64 of the cassette unit 16 serves to guide the first and second tablet batches. As further shown in FIG. 5, the upper hopper 64 is defined by a front panel 70, a rear panel 72 and side panels 74, wherein an angle A defined by the front panel 70 and a horizontal line is larger than a corresponding angel B defined by the rear panel and the horizontal line.

The tablet packaging assembly 56 is disposed below the lower hopper 44 for packaging the tablet batches selectively released from the tablet cassettes 52 and the tablet containers 24 into a plurality of tablet paper bags 68. The packaging assembly comprises a heater 76 to seal said tablet batches into the tablet paper bags 68 using a packaging paper 78, and a printer 80 provided adjacent to the heater 76 to print a prescription information on the packaging paper 78.

An advantage the present invention is that the rotational tablet supplying mechanism realized by the turntable 14 and the support rail 40 therebelow reliably combines a manual tablet distribution into the tablet containers 24 with an automated tablet conveying and dropping into the packaging assembly 56 for the tablet packaging, thereby substantially improving efficiency of prescription drug packaging.

Another advantage is that the tablet supplying and packaging apparatus optimally combines a turntable container based system and a cassette based system, thereby enabling a small to medium size drugstore to economically adopt an automated tablet distributing and packaging facility.

Further, the numbering system implemented on the disk of the turntable further facilitates the manual tablet distribution in the tablet containers with accuracy, thereby maximizing efficiency of the tablet supplying and packaging mechanism.

Although the invention has been described in considerable detail, other versions are possible by converting the aforementioned construction. Therefore, the scope of the invention shall not be limited by the specification specified above and the appended claims.

What is claimed is:

1. A tablet supplying and packaging apparatus, comprising:

a) a housing having an upper surface;

b) a turntable exposedly embedded in the upper surface of the housing, wherein the turntable has a center and a plurality of tablet containers disposed around the center, wherein the turntable angularly rotates on the center thereof, wherein said each tablet container is defined by side walls, a top opening and a bottom opening;

c) a plurality of plates corresponding to the plurality of tablet containers, wherein said each plate is hingedly engaged to a tablet container portion adjacent to the bottom opening of said each tablet container to releasably close the bottom opening of said each tablet container, whereby one or more tablets serving as a first tablet batch for a unit dosage are either maintained in said each tablet container when the bottom opening is closed by said plate or downwardly discharged when said plate is released;

d) a cassette unit having an upper hopper, a cassette stand and a row of tablet cassettes detachably mounted on the cassette stand, wherein the cassette stand is formed on the upper surface of the housing in adjacency to the turntable, wherein the upper hopper is formed below the cassette stand and through the upper surface of the housing, whereby one or more tablets serving as a second tablet batch for the unit dosage are released from the tablet cassettes and guided by the upper hopper;

e) a lower hopper disposed below the turntable and the upper hopper of the cassette unit to guide the first and second tablet batches; and f) a tablet packaging assembly disposed below the lower hopper for packaging the tablet batches selectively released from said tablet cassettes and said tablet containers into a plurality of tablet paper bags.

2. The apparatus of claim 1 further comprising:

a) a support rail having a release opening, wherein the support rail is disposed beneath the bottom openings of the tablet containers to uphold the plates, wherein when one selected from the tablet containers reaches over the release opening in accordance with the angular rotation of the turntable, the plate corresponding to the selected tablet container is lowered through the release opening so that the tablets in the selected tablet container are downwardly released through the release opening into the lower hopper;

b) a vertical shaft fixed to the center of the turntable to support and center the turntable; and c) an operation control administering the turntable and the tablet cassettes for a tablet release operation in accordance with a data input therein.

3. The apparatus of claim 2 wherein the vertical shaft is engaged thereto by a motor to generate a force for the angular rotation of the turntable, wherein the motor is controlled by the operation control.

4. The apparatus of claim 2 wherein the angular rotation of the turntable is clockwise.

5. The apparatus of claim 2 wherein the angular rotation of the turntable is counter-clockwise.

6. The apparatus of claim 2 further comprising a sensor connected to the operation control for sensing the angular rotation of the turntable in accordance with the operation control to allow the tablets to be regularly discharged from the tablet containers through the release opening into the packaging assembly.

7. The apparatus of claim 6 wherein said each tablet container has a sensing member disposed adjacent thereto to enable the sensor to detect the angular rotation of the turntable in accordance with the operation control, wherein the sensing member is magnetized.

8. The apparatus of claim 1 wherein the upper hopper is defined by a front panel, a rear panel and side panels, wherein an angle defined by the front panel and a horizontal line is larger than a corresponding angle defined by the rear panel and the horizontal line.

9. The apparatus of claim 1 wherein the packaging assembly comprises:

a) a heater to seal said tablet batches into the tablet paper bags using a packaging paper; and b) a printer provided adjacent to the heater to print a prescription information on the packaging paper.

10. A tablet supplying and packaging apparatus, comprising:

a) a housing having an upper surface;

b) a turntable exposedly embedded in the upper surface of the housing, wherein the turntable has a center, a plurality of tablet containers disposed around the center, and a disk provided between the turntable center and the tablet containers, wherein the disk serves to identify said each container, wherein the turntable angularly rotates on the center thereof, wherein said each tablet container is defined by side walls, a top opening and a bottom opening;

c) a plurality of plates corresponding to the plurality of tablet containers, wherein said each plate is hingedly engaged to a tablet container portion adjacent to the bottom opening of said each tablet container to releasably close the bottom opening of said each tablet container, whereby one or more tablets serving as a first tablet batch for a unit dosage are either maintained in said each tablet container when the bottom opening is closed by said plate or downwardly discharged when said plate is released;

d) a cassette unit having an upper hopper, a cassette stand and a row of tablet cassettes detachably mounted on the cassette stand, wherein the cassette stand is formed on the upper surface of the housing in adjacency to the turntable, wherein the upper hopper is formed below the cassette stand and through the upper surface of the housing, whereby one or more tablets serving as a second tablet batch for the unit dosage are released from the tablet cassettes and guided by the upper hopper;

e) a lower hopper disposed below the turntable and the upper hopper of the cassette unit to guide the first and second tablet batches; and f) a tablet packaging assembly disposed below the lower hopper for packaging the tablet batches selectively released from said tablet cassettes and said tablet containers into a plurality of tablet paper bags.

11. The apparatus of claim 10 further comprising:

a) a support rail having a release opening, wherein the support rail is disposed beneath the bottom openings of the tablet containers to uphold the plates, wherein when one selected from the tablet containers reaches over the release opening in accordance with the angular rotation of the turntable, the plate corresponding to the selected tablet container is lowered through the release opening so that the tablets in the selected tablet container are downwardly released through the release opening into the lower hopper;

b) a vertical shaft fixed to the center of the turntable to support and center the turntable; and c) an operation control administering the turntable and the tablet cassettes for a tablet release operation in accordance with a data input therein.

12. The apparatus of claim 11 wherein the vertical shaft is engaged thereto by a motor to generate a force for the angular rotation of the turntable, wherein the motor is controlled by the operation control.

13. The apparatus of claim 11 wherein the angular rotation of the turntable is clockwise.

14. The apparatus of claim 11 wherein the angular rotation of the turntable is counter-clockwise.

15. The apparatus of claim 11 further comprising a sensor connected to the operation control for sensing the angular rotation of the turntable in accordance with the operation control to allow the tablets to be regularly discharged from the tablet containers through the release opening into the packaging assembly.

16. The apparatus of claim 15 wherein said each tablet container has a sensing member disposed adjacent thereto to enable the sensor to detect the angular rotation of the turntable in accordance with the operation control, wherein the sensing member is magnetized.

17. The apparatus of claim 10 wherein the upper hopper is defined by a front panel, a rear panel and side panels, wherein an angle defined by the front panel and a horizontal line is larger than a corresponding angel defined by the rear panel and the horizontal line.

18. The apparatus of claim 10 wherein the packaging assembly comprises:

a) a heater to seal said tablet batches into the tablet paper bags using a packaging paper; and b) a printer provided adjacent to the heater to print a prescription information on the packaging paper.

19. The apparatus of claim 10 wherein the disk of the turntable is rotatable either separately from the turntable or engagedly to the turntable.

20. The apparatus of claim 19 wherein the disk has a numbering system to visually gauge a tablet loading in the tablet containers.

* * * * *